United States Patent [19]

Burnette

[11] 4,369,761

[45] Jan. 25, 1983

[54] WOOD BURNING STOVE

[76] Inventor: Clarence S. Burnette, No. 20 Woodwinds, Montaque Rd., Greenville, S.C. 29609

[21] Appl. No.: 157,683

[22] Filed: Jun. 9, 1980

[51] Int. Cl.[3] ..... F24C 1/14

[52] U.S. Cl. ..... 126/63; 126/67; 126/123; 126/126

[58] Field of Search ..... 126/121, 67, 65, 63, 126/69, 289, 123, 126; 312/236, 205, 292; 220/437, 439; 165/67, 68

[56] References Cited

U.S. PATENT DOCUMENTS

| | | | |
|---|---|---|---|
| 2,259,519 | 10/1941 | Ershler | 312/236 W X |
| 2,954,003 | 9/1960 | Farrell et al. | 220/439 |
| 3,155,265 | 11/1964 | Reese | 220/437 |
| 3,190,279 | 6/1965 | Davis | 126/63 |
| 4,074,679 | 2/1978 | Jensen | 126/121 |
| 4,179,065 | 12/1979 | Zung | 126/63 |
| 4,180,052 | 12/1979 | Henderson | 126/69 |
| 4,185,610 | 1/1980 | Buckner | 126/63 |
| 4,201,185 | 5/1980 | Black | 126/67 |
| 4,204,517 | 5/1980 | Rumsey | 126/63 |
| 4,249,510 | 2/1981 | Anderson | 126/121 |

*Primary Examiner*—Daniel J. O'Connor

*Attorney, Agent, or Firm*—Ralph Bailey

[57] ABSTRACT

This disclosure relates to a wood burning stove which includes an innermost combustion chamber within and generally spaced from an intermediate air-circulating chamber in turn generally within an outermost chamber, all of the chambers having generally spaced top, rear, bottom and pairs of side walls, all of the side walls having openings and ducts associated therewith through which air is introduced into the combustion chamber, all of the top walls having openings housing a duct through which products of combustion are exhausted from the combustion chamber, openings in the bottom walls of the intermediate and outermost chambers through which hot air is directed from the hot-air chamber for subsequent utilization, damper means associated with the top wall of the combustion chamber and the bottom wall of the intermediate chamber for respectively regulating the flow of gases through the openings or ducts associated therewith, and openings in the rear walls of the outermost and intermediate chambers through which air is blown by an associated blower for circulating within the hot-air chamber and being blown outwardly therefrom through the openings of the bottom walls and the ducts associated therewith as well as front openings in a front wall of the stove.

5 Claims, 11 Drawing Figures

5
125
13
103
53
15
12
11
10
42,43
73
44
38
33
39
12
13
56
164
47
60
191
14
81
32
6
54
175
6
48
34
11
58
108
173
72
64
86
90
30
99
184
21
82
84
20
127
126
26
22
5
25
113
24
23

4
125
11
12
10
13
38
39
53
164
10
15
153
152
153
168
176
52
51
170
174
168
176
170
157
157
175
134
169
177
173
135
172
169
143
143
146
146
171
99
171
177
189
90
20
126
21
23
4

WOOD BURNING STOVE

An object of this invention is to provide a novel wood burning stove particularly adapted for utilization or installation in mobile homes, although the same is readily adapted for installation in conventional residences, such as single family dwellings, apartment houses, condominiums, or the like, the stove including an innermost combustion chamber, an intermediate hot-air circulating chamber, and an outermost chamber with the chambers being in generally spaced telescopic relationship and each including a top wall, a rear wall, a bottom wall, and spaced side walls. The top walls having openings and an associated duct for exhausting combustion gases to atmosphere, the side walls having openings and an associated duct for introducing air into the combustion chamber, and the bottom walls of at least the intermediate hot-air chamber and the outermost chamber having openings and an associated duct for conducting hot air from the intermediate hot-air chamber to the duct system of a mobile or like home for utilizing heat generated within the combustion chamber to heat a mobile home or the like.

A further object of this invention is to provide a novel wood burning stove of the type just described including opening means in the rear walls of the outermost chamber and the intermediate hot-air circulating chamber, a blower carried by the rear wall of the outermost chamber, and means between the rear walls of the combustion chamber and the intermediate hot-air chamber for dividing an air stream created by the blower means into generally two distinct upper and lower paths directed above respective top and bottom walls of the combustion chamber for subsequent discharge through the hot air outlet in the bottom wall of the intermediate hot-air chamber.

Still another object of this invention is to provide a novel stove of the type just described wherein additional deflectors are carried by the rear wall of the combustion chamber and are disposed in pairs diverging upwardly and downwardly to further direct air introduced into the hot-air circulating chamber by the blower into generally surrounding relationship to the entire exterior of the combustion chamber, and the side walls of the combustion chamber further including forwardly converging air directing plates for directing hot air outwardly through hot-air openings in a front wall of the stove.

Another object of this invention is to provide a novel stove of the type aforesaid wherein a sliding damper is carried by the top wall of the innermost combustion chamber, and means are provided to prevent the damper from being fully closed.

Yet another object of this invention is to provide a novel stove constructed in the manner aforesaid wherein first and second support means are provided between the outermost and intermediate chamber bottom walls and the intermediate and combustion chamber bottom walls, respectively, for supporting the innermost, intermediate and outermost chambers in generally spaced relationship, the latter support or support means being in the form of parallel vertical walls which are further associated with pairs of downwardly depending guide rods carried by the bottom walls of the innermost combustion chamber and the intermediate hot-air circulating chamber for facilitating the telescopic assembly of the chambers during assembly or manufacture.

Still another object of this invention is to provide a novel stove of the type described wherein the support or supporting means of the bottom wall of the intermediate air-circulating chamber are a pair of rails which define therebetween a passage for directing air from within the interior of the air-circulating chamber to the opening in the bottom wall thereof, and a damper associated with the latter for regulating the hot-air flowing therefrom.

Still another object of this invention is to provide a hearth having a generally horizontal wall atop which the stove resets, bracket means carried by the side walls of the outermost chamber, and means for rapidly removably securing the bracket means to the hearth.

Still another object of this invention is to provide a novel stove of the type immediately set forth wherein means are provided for defining an air passage between the front wall of the stove along each side wall of the outermost chamber and at least in part along the rear wall of the latter for conducting air into the blower.

Another object of this invention is to provide a novel stove of the type aforesaid wherein the rear or back wall of the outermost chamber and the intermediate hot-air chamber is provided with an opening in which is mounted a thermostat for detecting the heat within the hot-air chamber and means for operating the blower in response to the thermostat.

Another object of this invention is to provide a damper associated with the opening in the side wall of the outermost chamber, the damper including a generally flat damper plate received in parallel horizontal guides, a block or plate inboard of the front wall for limiting the movement of the damper plate, and means for removably securing the guides, the plate, and a duct associated therewith to the side wall of the stove for purposes of ready replacement and repair.

Still another object of this invention is to provide a novel stove of the type described wherein the entire interior spaced between the outermost chamber and the intermediate hot-air chamber is filled with insulation so that the stove might be installed under zero clearance specifications in an associated wall structure or the like of a mobile home, residence, etc.

With the above and other objects in view that will hereinafter appear, the nature of the invention will be more clearly understood by reference to the following detailed description, the appended claims and the several views illustrated in the accompany drawings.

In the drawings

FIG. 1 is a schematic view of the novel wood burning stove of this invention, and illustrates the same installed in a mobile home or the like with appropriate duct work for introducing air into the combustion chamber, exhausting combustible gases through an outlet duct and its associated chimney, and directing hot air for heating purposes downwardly through a duct in intermediate and outer chambers of the stove.

FIG. 2 is a fragmentary perspective view of the stove with parts broken away for clarity, and illustrates details thereof including a duct for directing air from an air inlet opening of the front wall toward a pair of blowers carried by a rear wall of the outer chamber, a thermostat for controlling the blower, and deflectors carried by rear and side walls of the combustion chamber for directing hot air passing through the air-circulating chamber.

Figure 2:
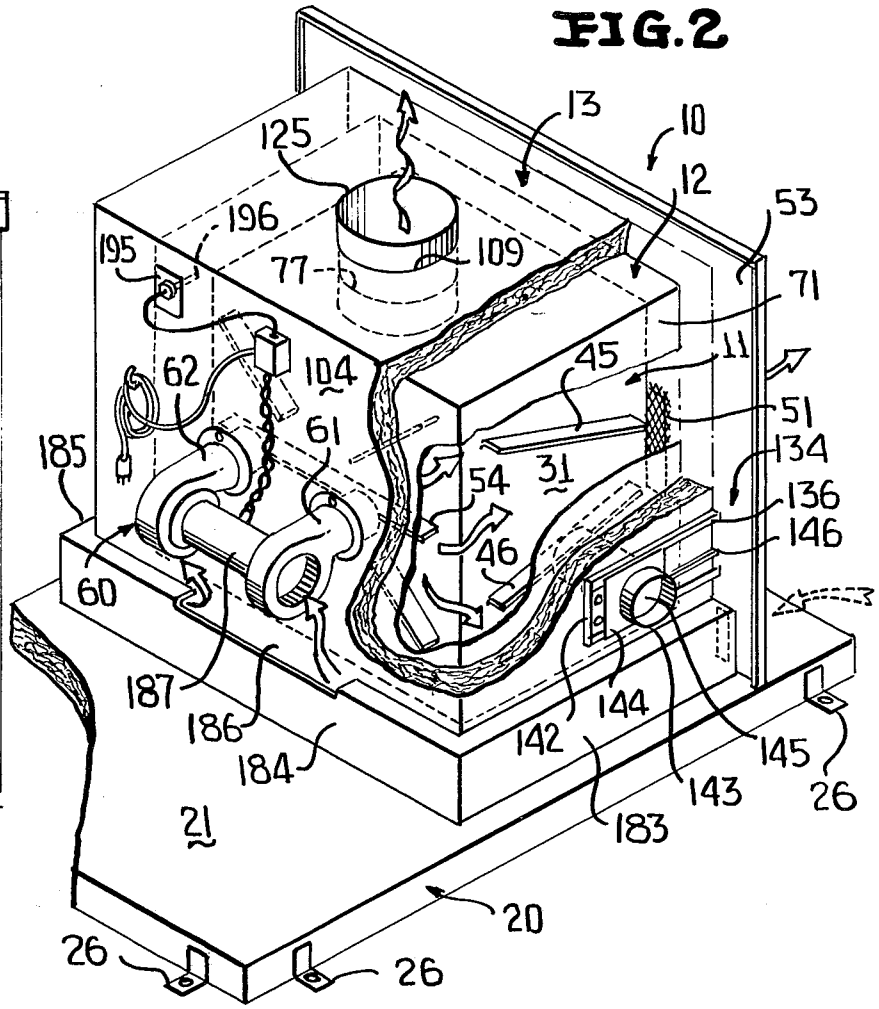

This invention relates to a solid fuel burning stove, particularly a stove for burning wood which is generally designated by the reference numeral 10 (FIGS. 2 through 7).

The stove 10 is preferably designed to be installed within a mobile home H (FIG. 1) which may, of course, be supported in a conventional manner upon cinder blocks B or like supports. The stove 10 rests upon a floor F and is connected by suitable ducts, as will be described more fully hereinafter, to a main air supply or main air duct D of the mobile home H which, of course, though it runs beneath the floor F has branch ducts (not shown) which introduces hot air from the stove 10 back into the interior of the mobile home H in a known manner. Gases of combustion exit the stove 10 through a conventional stack or chimney C while other ducts D1, D2 are connected to the stove 10, again as will be described more fully hereinafter, to communicate outside air into the stove 10.

The stove 10 rests upon a hearth 20, which is preferably made of steel and includes a rectangular top wall 21 having a circular hole or opening 22 and a peripheral downwardly depending wall 23. The interior of the hearth 20 is covered with insulating material 24 (FIGS. 2, 4 and 5) having a circular opening or hole 25 in alignment with the hole or opening 22 of the wall 21. A plurality of attachment brackets 26 are welded to the peripheral wall 23 of the hearth 20 and suitable screws or bolts (not shown) are used to attach the brackets 26 and, thus, the hearth 20 to the floor F of the mobile home H, residence, or the like. Though this invention is described herein with particular reference to the mobile home H, earlier described, it is to be understood that the stove 10 may, of course, be utilized in other environments, namely, permanent homes, condominiums, apartments, etc.

The stove 10 further includes three relative distinct structures or wall means 11, 12 and 13 (FIGS. 2 through 7) defining an innermost combustion chamber, compartment or box 11, an intermediate air-circulating chamber, compartment or box 12, and an outermost chamber, compartment or box 13.

Figure 1:
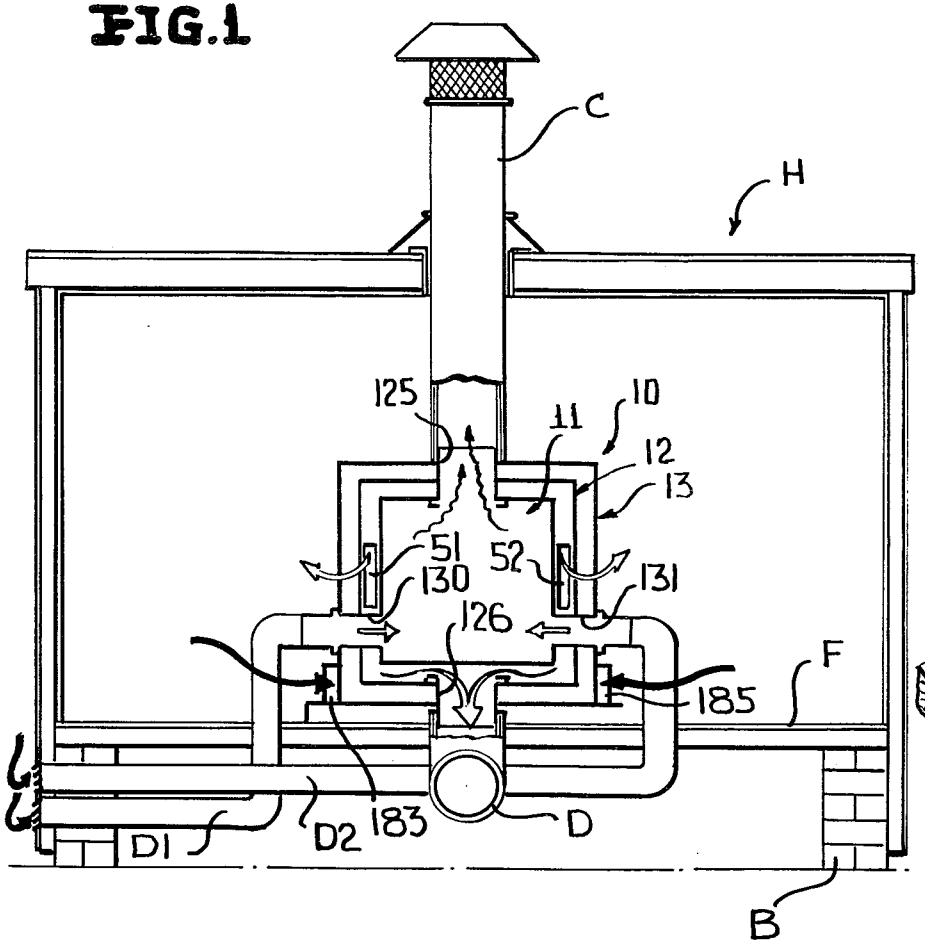

It is within the combustion chamber 11 that the wood or other material is positioned for burning while the compartments or chambers 11 and 12, which are in generally spaced relationship to each other, define therebetween a hot-air circulating chamber 14 (FIGS. 4 through 6) while an area between the chambers or compartments 12, 13 defines a similar chamber 15 within which is housed approximately two inches of mineral wool insulation to permit zero clearance installation of the stove 10 within the mobile home H (FIG. 1).

Figure 5:
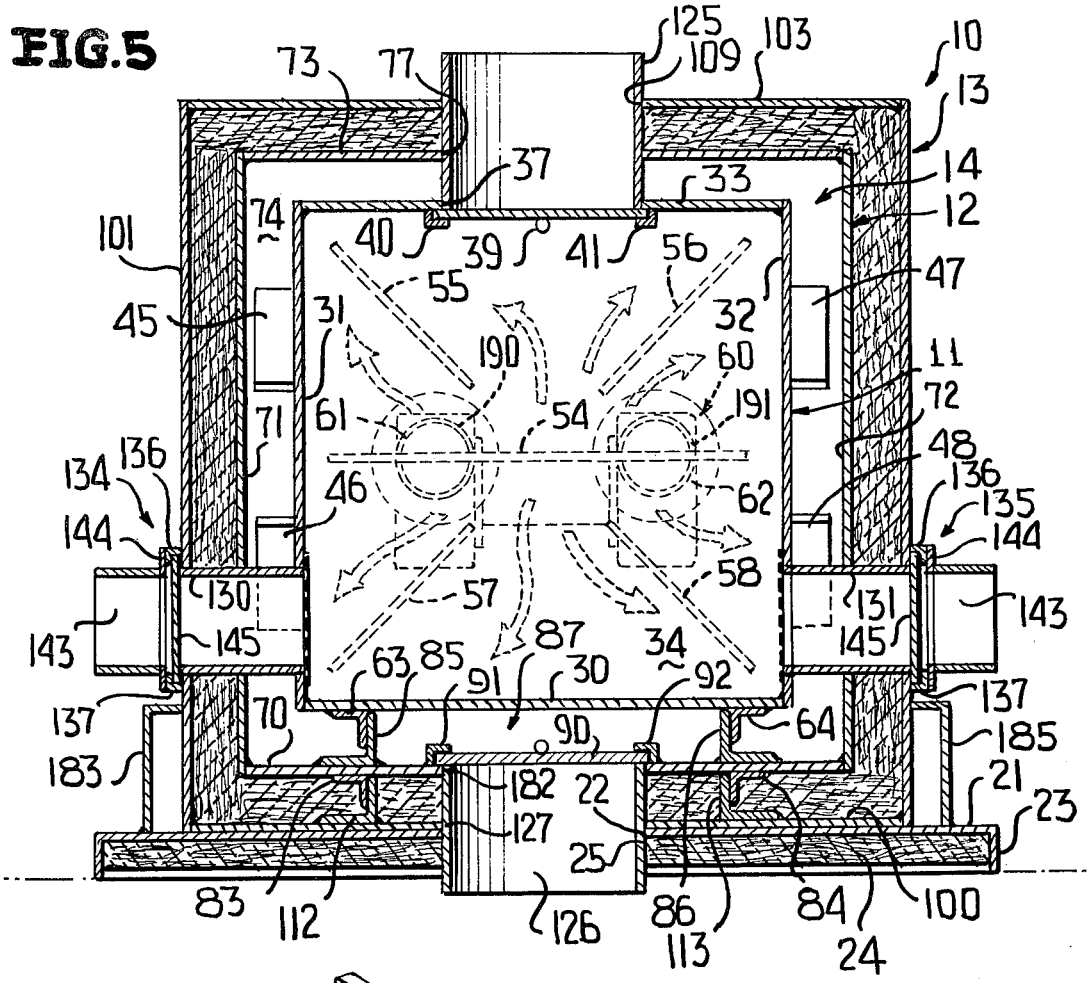
FIG. 5 is a sectional view taken generally along line 5—5 of FIG. 4 and illustrates details of the telescopic support of the chambers and the manner in which guide rails of the inner combustion chamber and the intermediate air-chamber define an air channel for directing air toward the hot-air outlet duct.
Figure 7:
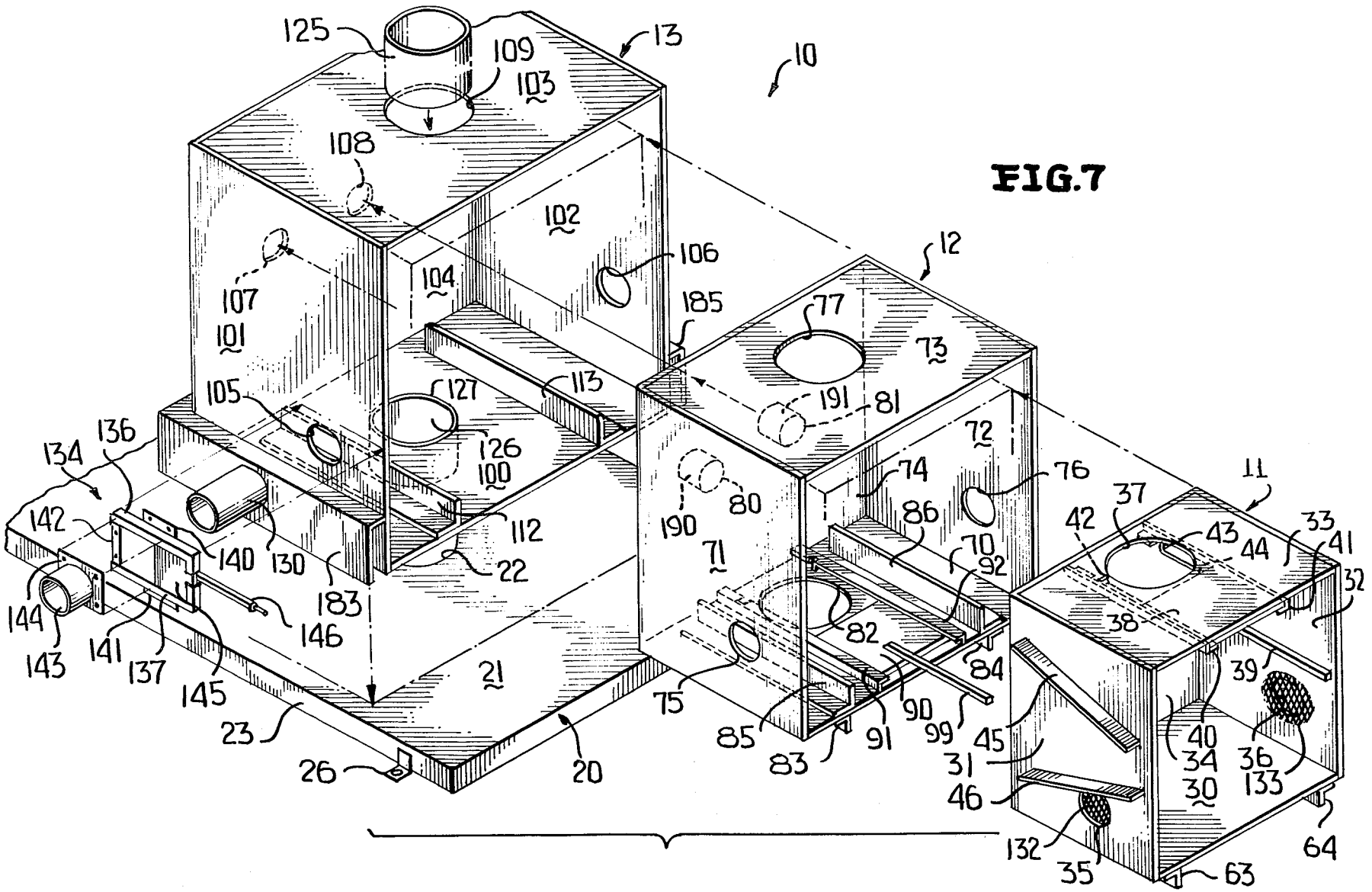
FIG. 7 is an exploded perspective view of the stove, and illustrates the various chambers and associated structure thereof prior to assembly.

Reference is now made specifically to FIGS. 5 and 7 of the drawings and the firebox or chamber 11 which includes a generally rectangular bottom wall 30, a first side wall 31, a second side wall 32, a top wall 33, and a rear wall 34. The bottom wall 30 has no aperture whatsoever therein, whereas the side walls 31, 32 have respective circular apertures 35, 36, The purpose of which is to permit combustion air to be introduced into the firebox or fire chamber 11, as will be more apparent hereinafter.

Figure 8:
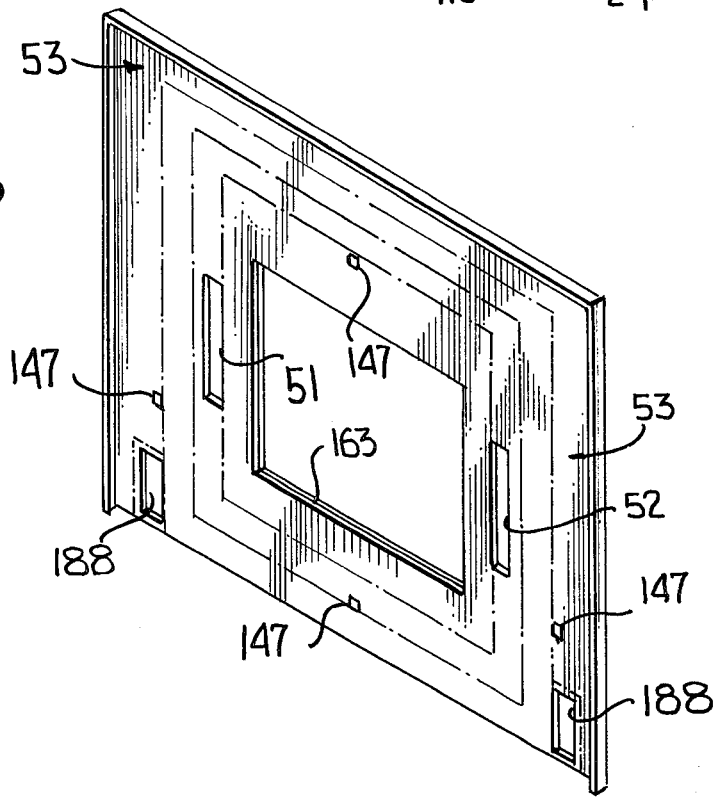
FIG. 8 is a perspective view of a front panel or a wall of the stove, and illustrates various openings therein for accommodating air inlets, outlets, and an access opening to the inner combustion chamber.
Figure 6:
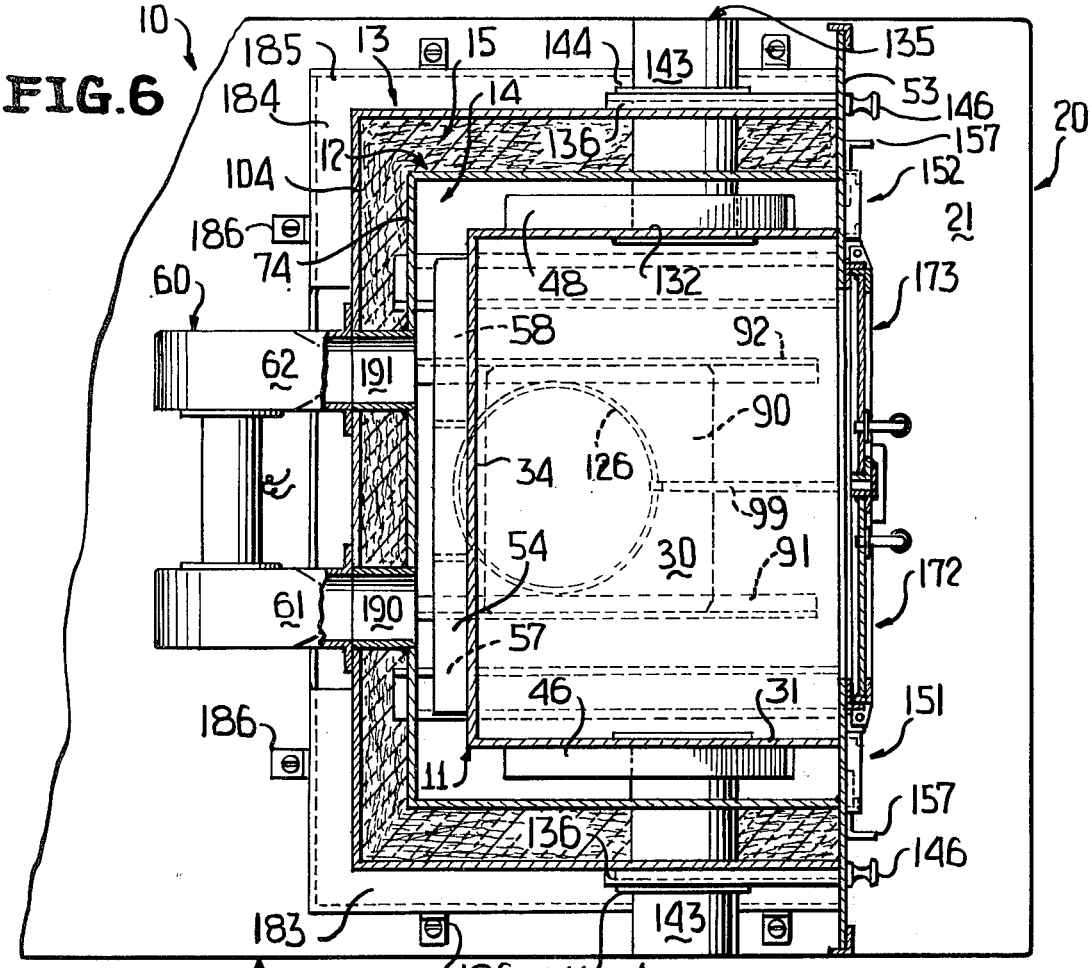
FIG. 6 is a cross-sectional view taken generally along line 6—6 of FIG. 4, with parts broken away for clarity, and illustrates the manner in which air is introduced by the blower into the inner-circulating chamber.

Smoke, combustible gases or the like exit the firebox 11 through an opening 37 formed in the top wall 33. The opening 37 may be regulated in size through the use of a damper 38 having a handle 39 with the damper 38 being slidingly received in a pair of angle irons 40, 41. A pair of stops 42, 43 (FIGS. 4 and 7) are welded to the underside of the top wall 33 and project slightly downwardly therefrom. The purpose of the stops 42, 43 are to be abutted by an edge 44 of the damper 38 thereby preventing the damper from totally closing the opening 37, as is most evident in FIGS. 4 and 7. The side wall 32 has a pair of air deflectors 45, 46 which converge toward each other in a direction away from the rear wall 34 with the lowermost air deflector 46 being spaced slightly above the hole or opening 35. Similar air deflectors 47, 48 (FIGS. 4 and 5) are in converging relationship in a direction away from the rear wall 34 and are similarly welded to the side wall 32 of the firebox 11. The function of the air deflectors 45 through 48 is to direct air toward a pair of air outlets 51, 52 (FIGS. 2, 3 and 8) formed in a front plate or wall 53 of the stove 10.

The rear wall 34 of the firebox 11 includes a horizontal air deflector 54 (FIGS. 2, 4 and 5) located approximately midway between the bottom wall 30 and the top wall 33, a pair of upperwardly diverging air deflectors 55, 56 and a pair of lower downwardly diverging air deflectors 57, 58. The air deflectors 55, 56 deflect air blown toward the horizontal air deflector 54 upwardly and sidewise, whereas the lower air deflectors 57, 58 similarly direct air blown toward the horizontal air deflector 54 downwardly and sidewise, as is indicated by the unnumbered arrows in FIGS. 5 and 7. The air directed toward the horizontal air deflector 54 is created by a dual blower which is generally designated by the reference number 60. The dual blower includes two outlets 61, 62 (FIGS. 2 and 5) which communicate with the hot-air circulating chamber 14 (FIG. 4) in a manner to be described more fully hereinafter.

Welded to the bottom wall 30 or the firebox or combustion chamber 11 are a pair of angle irons 63, 64 (FIGS. 5 and 7) which perform the dual function of providing a guide in assembling the combustion chamber 11 into the intermediate chamber 12, and serving as a duct in combination with angle irons to be described more fully hereinafter projecting upwardly from a bottom wall of the hot-air chamber 12, again as will be described more fully hereinafter.

The hot-air compartment or chamber 12 (FIGS. 4 through 7) similar includes a bottom wall 70, a side wall 71, another side wall 72, a top wall 73, and a rear wall 74. Apertures or openings 75, 76 are formed in the respective side walls 71, 72 and these openings are in alignment with the respective apertures or openings 35, 36 in the side walls 31, 32 of the combustion chamber 11.

The top wall 73 of the hot-air chamber 12 includes a circular opening 77 which is in registration with the opening 37 in the top wall 33 of the combustion chamber 11.

The rear wall 74 of the intermediate chamber 12 includes two circular (or rectangular) openings 80, 81 which are connected to the outlet 61, 62 of the dual blower 60, as will be described more fully hereinafter.

The bottom wall 70 of the intermediate air-circulating chamber 12 includes a circular opening 82 through which hot air is distributed into the interior of the mobile home H or like living area, as will be described more fully hereinafter in conjunction with FIG. 1.

A pair of generally parallel disposed angle irons 83, 84 (FIG. 5) are welded to the underside of the bottom wall 70 and slidingly guidingly mate with angle irons, to be described more fully hereinafter, associated with the outermost chamber 11.

Welded to the upper or inside of the bottom wall 70 of the intermediate chamber or compartment 12 are a pair of angle irons 85, 86 which receive and form guides with the downwardly depending angle irons 63, 64, respectively, carried by the bottom wall 30 of the combustion chamber 11 (FIG. 5). The angle irons 63, 85 and 64, 86 also function to define a generally rectangularly shaped duct 87 (FIG. 5) running from the rear wall 74 to the front wall 53 into which air can be blown by the fan or blower 60 and, of course, the same will flow through the opening 82 if, of course, a damper 90 is in its open position, it being noted that the damper 90 is guided for sliding movement between angle irons 91, 92 welded to the inside of the bottom wall 70 of the intermediate air-circulating compartment 12.

The angle irons 85, 86 are spaced inwardly from the rear wall 74 of the intermediate hot-air chamber 12 by approximately one to two inches, as is best illustrated in FIG. 7, but the forward edges thereof (also FIG. 7) abut against the front wall 53. Thus, any air introduced into the duct or passage 87 in the area of the rear wall 74 must flow down through the opening 82 since its forward motion or flow is precluded by the front wall 53. In this manner, the hot air which is introduced into the duct or passage 87 is assured of flowing in an efficient manner through the opening 82 and associated duct work into the interior of the mobile home H. Thus, as air is blown into the hot-air circulating chamber 14 by the blower 60 through the openings 80, 81, such air is deflected by the air deflectors 54 through 58 and particularly if the outlets 51, 52 in the front wall 53 are closed, the air will simply be directed by the duct 87 into the hot air opening 82 of the bottom wall 70 and thence to an appropriate area which is to be heated via the duct system D (FIG. 1). If, of course, the damper 91 is closed, the hot air will simply rise and be forced outwardly through the opening 77.

The outer chamber 13 includes a bottom wall 100, a side wall 101, a side wall 102, a top wall 103, and a rear wall 104. Apertures 105, 106 are formed in the respective side walls 101, 102, and these apertures are in alignment with the apertures 35, 36 and 75, 76 in the side walls 31, 32 and 71, 72 of the respective chambers 11, 12. The rear wall 106 also includes a pair of circular apertures or openings 107, 108 in alignment with the respective openings 80, 81 of the rear wall 74 of the chamber 12. A circular opening 109 is also formed in the top wall 103 and is in registry with the openings 37, 77 of the top walls 33, 73 of the chambers 11, 12, respectively.

The bottom wall 100 of the outermost chamber 13 includes a pair of angle irons 112, 113 which are welded to the bottom wall 100 and which are in alignment with and are guided by the angle irons 83, 84, respectively (FIGS. 5 and 7) depending from the bottom wall 70 of the intermediate chamber 12.

Figure 4:
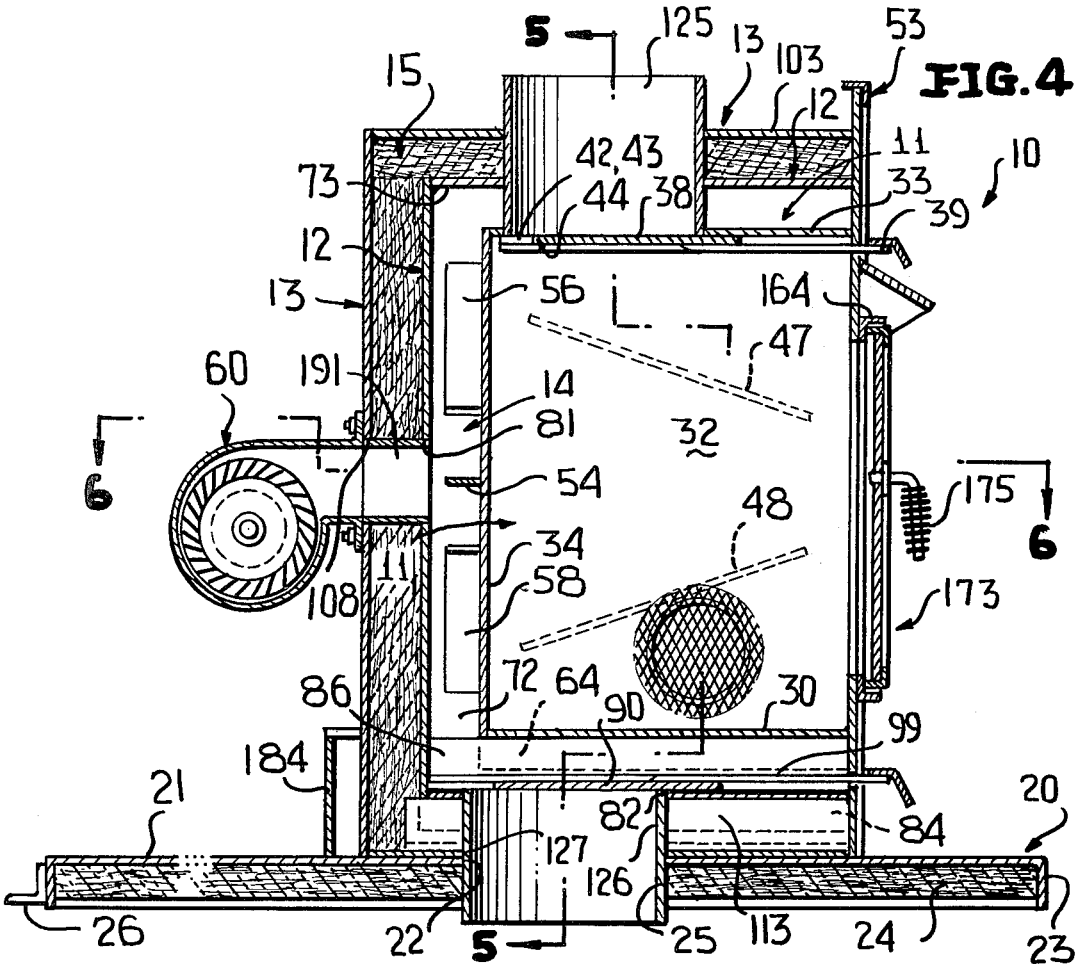
FIG. 4 is a cross-sectional view taken generally along line 4—4 of FIG. 3, and illustrates details of the stove including the air deflectors, ducts, associated dampers and a blower.

A duct or conduit 125 (FIGS. 4, 5 and 7) is received in the openings 37, 77 and 109 of the respective top walls 33, 73 and 103 of the respective chambers 11, 12 and 13, and is welded to each. A similar duct 126 (FIGS. 4 and 7) is received in a circular opening 127 of the bottom wall 100 of the chamber 12 and is also received in the opening 82 of the bottom wall 70 of the chamber 12 and the opening 22 of the hearth 20 (FIGS. 4 and 5). The duct 125 is, of course, connected to the chimney or stack C in a conventional manner (FIG. ), while the duct 126 is connected to the duct work D (FIG. 1) of the mobile home H. Thus, gases of combustion arising from a fire within the combustion chamber 11 are conducted to atmosphere through the duct 125 and the chimney or stack C (FIG. 1) whereas hot air within the chamber 14 between the walls of the combustion chamber 11 and the hot-air circulating chamber 12 are conducted through the duct 126 to the duct work D of the mobile home H with, of course, the degree of combustion and gas and air circulation being regulated by the operation of the blower 60 (or the nonoperation thereof) and the position of the dampers 38, 90.

Air from the ducts D1, D2 is directed into the combustion chamber 11 through respective tubular ducts or pipes 130, 131 (FIGS. 3, 5, 6 and 7) which are received in the respective openings 35, 75 and 105 of the side walls 31, 71 and 101 and the openings 36, 76 and 106 of the respective side walls 32, 72 and 102 of the respective chambers 11, 12 and 13. Screens 132, 133 (FIGS. 5 and 7) close the openings 35, 36, respectively. Dampers 134, 135 (FIG. 5) are carried by the respective side walls 101, 102 of the outermost chamber 13, and each of the dampers or damper means 134, 135 includes upper and lower angle bars or angle irons 136, 137 carrying respective apertured brackets 140, 141 through which metal screws pass for securing the brackets 136, 137 to the respective walls 101, 102. An end abutment plate 142 is also provided with bores (unnumbered) through which fasteners pass for securing the plate 142 to the side walls 101, 102, respectively. A short piece of duct or pipe 143 having a plate 144 is also removably secured by screws (not shown) to the angle irons 136, 137 in the manner readily apparent from FIGS. 5 and 7 of the drawings. A damper plate 145 carrying a handle 146 is guidingly slidingly received between the rails or angle irons 136, 137 and may be moved between positions opening and closing the ducts 130, 131 to atmosphere. The handles 146 of each of the damper plates 145 project through openings 147 (FIG. 8) in the front wall 53. The utilization of removable fastening means associated with the dampers 134, 135 permits the same or parts thereof to be readily removed from the respective walls 101, 102 should, for example, the damper plate 145 be worn out or should the same be removed from the handle 146. By removing the end abutment plate 142, the damper plate 145 can merely be slid rearwardly for removal from between the angle bars 136, 137 for purposes of repair and/or replacement.

Figure 11:
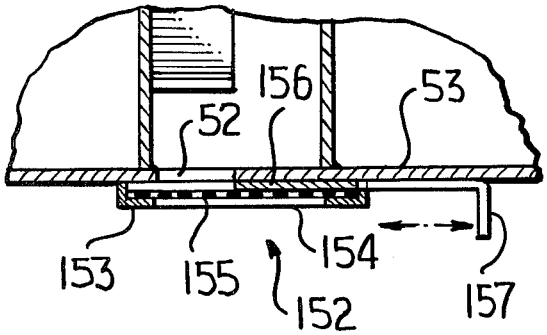
FIG. 11 is a slightly enlarged sectional view taken generally along line 11—11 of FIG. 3, and illustrates a damper for regulating the flow of hot air from the air-circulating chamber outwardly of the stove into an associated area.

Identical dampers 151, 152 (FIGS. 3 and 11) are associated with the openings 51, 52 in the front wall 53 of the stove 10. The dampening means 151, 152 each include a generally rectangular angle iron frame 153 (FIGS. 3 and 11) defining a generally rectangular opening 154 covered by a screen 155. An elongated generally rectantular damper plate 156 is sandwiched between the screen 155 and a portion of the front wall 53. However, an exposed handle 157 of the damper plate 156 can be manipulated to move each of the damper plates 156 generally horizontally to open, close, or partially open or close the respective openings 51, 52, as is readily apparent from FIGS. 3 and 11 of the drawings.

Figure 3:
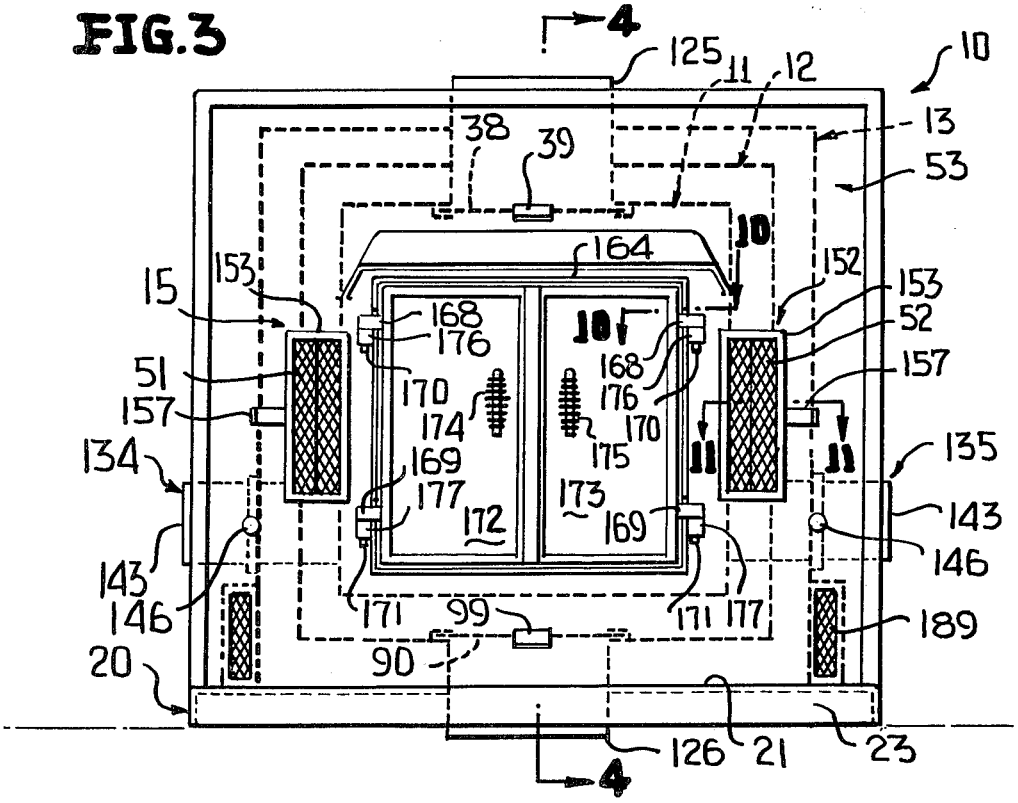
FIG. 3 is a front plan view of the stove of this invention, and illustrates a pair of dampers associated with air outlet openings and a pair of air inlet openings therebelow.
Figure 9:
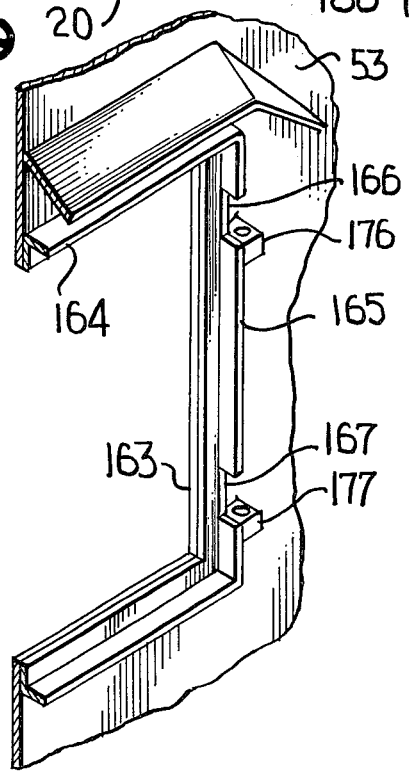
FIG. 9 is a fragmentary perspective view of a portion of the front wall of the stove, and illustrates the manner in which a door is removably secured thereto.
Figure 10:
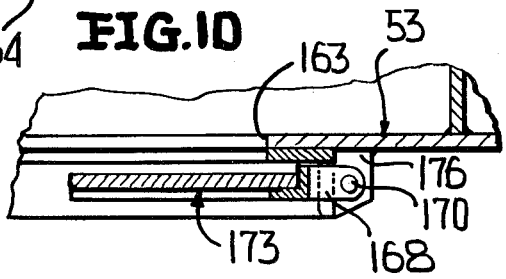
FIG. 10 is a slightly enlarged sectional view taken generally along line 10—10 of FIG. 3, and illustrates details of one of the doors and its associated hinge.

The front wall 53 also includes a rectangular opening 163 through which material, such as wood, is placed into the interior of the combustion chamber 11. The opening 163 is bounded by a piece of angle iron 164 welded thereto having along opposite vertical edge portions 165 (FIG. 9) notches 166, 167 through which project respective hinges 168, 169 carrying respective downwardly depending pins 170, 171 (FIG. 3) of a pair of doors 172, 173 having appropriate handles 174, 175, respectively, (FIG. 3). The pins 170, 171 of each of the doors 172, 173 are received in apertures (unnumbered) of lugs 176, 177 welded to the front wall 53 of the stove 10. In this fashion, the two doors 172, 173 can be readily removed by simply opening the same outwardly from the position shown in FIG. 3 and thence lifting each door upwardly to remove its pin 170, 171 from the aperture (unnumbered) of the respective lugs 176, 177.

Three angle irons 183 through 185 (FIGS. 2, 7 and 5) are secured in a removable fashion by brackets and fasteners, collectively designated by the reference numeral 186, to the wall 21 of the hearth 20. The angle irons 183 through 185 define an air duct or passage (unnumbered) with the respective walls 101, 104 and 102 of the outermost chamber 13, it being noted from FIG. 2 that an uppermost portion of the angle iron 184 is removed to define an outlet opening 186 through which air can be drawn upon energization of the motor 187 of the blower 60. Thus, when the motor 187 of the blower 60 is energized, air from the interior of the mobile home H is drawn through apertures 188 (FIG. 8) of the front wall 83 closed by appropriate screens 189 (FIG. 3) through the passage formed by the angle irons 183 through 185 in the associated walls 101, 104, and 102 for introduction into the combustion chamber 11 through tubular ducts 190, 191 within the aligned openings 80, 107 and 81,108 of the respective rear wall 74, 104 of the respective chambers 12, 13. A suitable theremostat 195 is secured to the rear wall 104 of the chamber 113 and its associated probe 196 passes through an opening (not shown) in the rear wall 74 to detect the air temperature within the chamber 14 and thereby operate the blower 60 in a safe and reliable manner. Essentially, the blower or fan 60 will cut off in the temperature within the chamber 14 between the chambers 11 and 12 (FIG. 4) reaches approximately 180° F. although this may be varied by utilizing a variety of different and/or adjustable heat sensors 195, 196.

Although in a preferred embodiment of the invention as has been specifically illustrated and described herein, it is to be understood that minor variations may be made in the apparatus without departing from the spirit and scope of the invention, as defined in the appended claims.

I claim:

1. A solid fuel burning stove comprising first means for defining an innermost combustion chamber within which fuel is adapted to be burned, second means generally housing said first means and being at least in part spaced therefrom for defining a hot-air circulating chamber, means defining a hot-air outlet in a wall of said hot-air circulating chamber for exhausting hot-air to a duct for heating purposes, means for blowing air through said hot-air circulating chamber and into said hot-air outlet, means defining an ambient-air inlet in a wall of said combustion chamber for introducing ambient-air into said combustion chamber, means for exhausting combustibles from within said combustion chamber to atmosphere, said hot-air outlet being defined in a bottom wall of said hot-air circulating chamber, said ambient-air inlet being defined in a side wall of said combustion chamber, means defining an outermost chamber housing therein in at least partial spaced relationship said hot-air circulating chamber, said hot-air outlet passing through a bottom wall of said outermost chamber, said exhausting means passing through said outermost chamber, said ambient-air inlet passing through said outermost chamber, insulating means generally entirely filling the space between said outermost and hot-air circulating chambers whereby zero clearance installation of said stove is possible, damper means in said hot-air circulating chamber for adjustably regulating the flow of hot-air through said hot-air outlet in said hot-air circulating chamber, and means for defining a hot-air flow passage between said bottom walls of said combustion and hot-air circulating chambers for directing hot-air to said hot-air outlets.

2. A solid fuel burning stove comprising first means for defining an innermost combustion chamber within which fuel is adapted to be burned, second means generally housing said first means and being at least in part spaced therefrom for defining a hot-air circulating chamber, means defining a hot-air outlet in a wall of said hot-air circulating chamber for exhausting hot-air to a duct for heating purposes, means for blowing air through said hot-air circulating chamber and into said hot-air outlet, means defining an ambient-air inlet in a wall of said combustion chamber for introducing ambient-air into said combustion chamber, means for exhausting combustibles from within said combustion chamber to atmosphere, said hot air outlet being defined in a bottom wall of said hot-air circulating chamber, said ambient-air inlet being defined in a side wall of said combustion chamber, means defining an outermost chamber housing therein in at least partial spaced relationship said hot-air circulating chamber, said hot-air outlet passing through a bottom wall of said outermost chamber, said exhausting means passing through said outermost chamber, said ambient-air inlet passing through said outermost chamber, insulating means generally entirely filling the space between said outermost and hot-air circulating chambers whereby zero clearance installation of said stove is possible, damper means in said hot-air circulating chamber for adjustably regulating the flow of hot-air through said hot-air outlet in said hot-air through said hot-air outlet in said hot-air circulating chamber, means between said bottom walls for defining a passage for directing hot-air to said hot-air outlet, and said hot-air directing passage is in part defined by a pair of guides along which slide said damper means.

3. A solid fuel burning stove comprising first means for defining an innermost combustion chamber within which fuel is adapted to be burned, second means generally housing said first means and being at least in part spaced therefrom for defining a hot-air circulating chamber, means defining a hot-air outlet in a wall of said hot-air circulating chamber for exhausting hot-air to a duct for heating purposes, means for blowing air through said hot-air circulating chamber and into said hot-air outlet, means defining an ambient-air inlet in a wall of said combustion chamber for introducing ambient-air into said combustion chamber, means for exhausting combustibles from within said combustion chamber to atmosphere, said hot-air outlet being defined in a bottom wall of said hot-air circulating chamber, said ambient-air inlet being defined in a side wall of said combustion chamber means defining an outermost chamber housing therein in at least partial spaced relationship said hot air-circulating chamber, said hot-air outlet passing through a bottom wall of said outermost chamber, said exhausting means passing through said outermost chamber, said ambient air inlet passing through said outermost chamber, insulating means generally entirely filling the space between said outermost and hot-air circulating chamber whereby zero clearance installation of said stove is possible, damper means in said hot-air circulating chamber for adjustably regulating the flow of hot-air through said hot-air outlet in said hot-air circulating chamber, a hearth upon which said stove rests, heat insulating means within said hearth for insulating said stove from an associated support surface, and an opening in said hearth through which hot-air passes via said hot-air outlet.

4. A solid fuel burning stove comprising first and second means for defining an innermost combustion chamber in generally spaced relationship to an outer hot-air circulating chamber, said chambers having adjacent spaced rear and bottom walls, an opening in said rear wall of outer hot-air circulating chamber through which air is adapted to be introduced into the space between said chambers, an opening in said bottom wall of said outer hot-air circulating chamber from which hot-air is conducted for heating purposes, damper means for adjustably regulating the flow of hot-air outwardly of said outer hot-air circulating chamber opening, means defining a hot-air passage between said bottom walls for directing hot-air between and along said bottom walls toward said outer hot-air circulating chamber opening, said hot-air passage means are a pair of generally parallel spaced walls between which is positioned said hot-air circulating chamber opening, and said combustion chamber bottom wall is supported upon upper edges of said parallel walls.

5. The stove as defined in claim 4 wherein said damper means includes a damper plate, said plate having a pair of side edges, a pair of guide rails guiding said edges for effecting sliding movement of said damper plate relative to said hot-air circulating chamber opening, and said guide rails being generally parallel to each other and being disposed between said parallel walls.

* * * * *